US007766170B2

(12) United States Patent
Månsson et al.

(10) Patent No.: US 7,766,170 B2
(45) Date of Patent: Aug. 3, 2010

(54) TRANSPORT UNIT AND METHOD OF MANUFACTURE THEREOF

(75) Inventors: Evert Månsson, Skånes Fagerhult (SE); Peter Nilsson, Lund (SE); Per Gustafsson, Bjärred (SE)

(73) Assignee: Ecolean Research & Development A/S, Copenhagen (DK)

( * ) Notice: Subject to any disclaimer, the term of this patent is extended or adjusted under 35 U.S.C. 154(b) by 94 days.

(21) Appl. No.: 12/300,511

(22) PCT Filed: May 4, 2007

(86) PCT No.: PCT/SE2007/000427

§ 371 (c)(1),
(2), (4) Date: Nov. 12, 2008

(87) PCT Pub. No.: WO2008/013486

PCT Pub. Date: Jan. 31, 2008

(65) Prior Publication Data

US 2009/0166235 A1 Jul. 2, 2009

(30) Foreign Application Priority Data

May 12, 2006 (SE) ..... 0601061

(51) Int. Cl.
*B65D 19/00* (2006.01)

(52) U.S. Cl. ..... 206/597; 206/391; 206/393; 206/394; 206/554; 53/399

(58) Field of Classification Search ..... 206/389, 206/391, 393, 394, 386, 410, 597, 599, 497, 206/554, 820; 53/399, 443, 447, 448, 461; 108/55.1, 55.5; 220/1.5; 410/35, 36, 77
See application file for complete search history.

(56) References Cited

U.S. PATENT DOCUMENTS 3,004,746 A 10/1961 Swingle
4,760,915 A * 8/1988 Boets et al. ..... 206/303

(Continued)

FOREIGN PATENT DOCUMENTS

DE 19626497 A1 1/1998
GB 874647 A 8/1961
GB 1510193 A 5/1978

(Continued)

*Primary Examiner*—Luan K Bui
(74) *Attorney, Agent, or Firm*—Volpe and Koenig, P.C.

(57) ABSTRACT

A transport unit comprises a load carrier, a load which comprises at least one coil of a web; the web being wound on a reel, a load distributing element, and a tightening strap, the load being carried by said load carrier in such a manner that the reel of said at least one coil is arranged perpendicular to the load carrier, the load having an upper surface facing said load distributing element, the load distributing element being arranged on the upper surface of the load, and the tightening strap enclosing a force-absorbing structure formed of the load carrier, the reel and the load distributing element and adapted to secure the load to the load carrier. The load carrier has a flat load surface, and the web comprises interconnected container blanks, the load having a lower surface which rests on the load surface and comprises an end face of the reel of the at least one coil and a bottom surface formed of a bottom edge of the web of interconnected container blanks. The invention also relates to a method of manufacturing such a transport unit.

20 Claims, 3 Drawing Sheets

U.S. PATENT DOCUMENTS

| | | | | | |
|---|---|---|---|---|---|
| 4,821,880 | A | * | 4/1989 | Ditton | 206/386 |
| 4,904,092 | A | * | 2/1990 | Campbell et al. | 206/554 |
| 4,998,619 | A | * | 3/1991 | Sowa et al. | 206/392 |
| 5,531,327 | A | * | 7/1996 | Darby | 206/597 |
| 5,551,563 | A | * | 9/1996 | Allen | 206/394 |
| 5,758,771 | A | | 6/1998 | Rose | |
| 5,974,981 | A | | 11/1999 | Ditton | |
| 7,128,209 | B2 | * | 10/2006 | Bringard et al. | 206/386 |
| 2006/0180493 | A1 | * | 8/2006 | Tan | 206/554 |

FOREIGN PATENT DOCUMENTS

| | | | |
|---|---|---|---|
| WO | 0158717 | A1 | 8/2001 |
| WO | 0158718 | A1 | 8/2001 |

* cited by examiner

TRANSPORT UNIT AND METHOD OF MANUFACTURE THEREOF

FIELD OF THE INVENTION

The present invention relates to a transport unit in the form of a load carrier which carries a load comprising at least one coil of a web of interconnected container blanks, said web being wound on a reel. The invention also concerns a method of manufacturing such a transport unit.

BACKGROUND ART

The invention is in the first place intended for use on transport units which comprise coils of container blanks which in a filled state form flexible containers of a collapsible type. By container of collapsible type is meant a container with walls of a flexible plastic material, which are flexible and connected to each other to define a compartment, whose volume is dependent on the relative position of the walls. In its unfilled state, the container, and thus its container blank, is flat. The container blanks can be provided in a form of a coil, in which in a continuous web of container blanks is wound on a reel.

One example of a container of a collapsible type comprises three wall portions, of which two form opposite side walls and a third forms a bottom wall. The container blanks for this type of containers can be made, for instance, by folding a continuous web of material in the form of a W, after which the wall portions are joined along connecting portions to define a closed compartment. The container blanks can also be made by joining three continuous webs of material, one of which is folded in the form of a V to form the above-mentioned bottom wall. Regardless of method, this results in a continuous web of container blanks which, seen in the transverse direction of the web, have a first portion with a first number of layers (two walls) and a second portion with a second number of layers (four walls). When winding such a web on a reel, a coil is obtained, which in the first portion has a first density and in the second portion has a second density. This difference in density causes problems in handling, packing and transport of the coils.

Due to the difference in density, the coils cannot be stacked on top of each other without problems of instability and interleaving of the turns of two coils stacked on each other. Such instability and interleaving may cause "upsetting" and damage to the container blanks.

In order to prevent this, the coils are currently transported one by one in separate boxes. This results in unnecessary costs and also an environmental problem in the form of unnecessary packing.

The problem of upsetting and interleaving is particularly obvious if the transports, which is usually the case, occur over very long distances on frequently poor roads and with several reloadings. Damage entirely due to transport occurs and it is difficult to prove who caused the damage in transporting, and thus who is to pay the expenses of a claim. Due to the difficult burden of proof, the claim costs for transport damage must be paid by the supplier of packing material instead of the forwarding agent.

It will be appreciated that the above problem may to a certain extent also occur if the web of container blanks, seen in the transverse direction of the web, comprises the same number of layers. However, the problems of upsetting are less obvious.

There is thus a need for an improved method of packing this type of packing material.

OBJECTS OF THE PRESENT INVENTION

The object of the present invention is to provide a transport-proof transport unit comprising a load in the form of at least one coil of container blanks and a method of manufacturing a transport-poof transport unit.

Another object is to provide such a transport unit and such a method to reduce the cost of packing and reduce the environmental influence.

Yet another object is to provide a transport unit comprising a load in the form of at least one coil of container blanks and a method of manufacturing such a transport unit, which transport unit satisfies the requirements according to ASTM D 4169-04a, DC2, thereby facilitating the burden of proof for any transport damage, thus making it possible to reduce the claim costs for the supplier of container blanks to a minimum.

SUMMARY OF THE INVENTION

To achieve the above objects and other objects not stated, which will be evident from the following description, the present invention relates to a transport unit according to claim 1 and a method of manufacturing a transport unit according to claim 10.

According to a first aspect, the invention relates to a transport unit comprising a load carrier, a load which comprises at least one coil of a web, said web being wound on a reel, a load distributing element, and a tightening strap, said load being carried by said load carrier in such a manner that the reel of said at least one coil is arranged perpendicular to said load carrier, said load having an upper surface facing said load distributing element, said load distributing element being arranged on the upper surface of the load, and the tightening strap enclosing a force-absorbing structure formed of the load carrier, the reel and the load distributing element and adapted to secure the load to the load carrier. The load carrier has a flat load surface, and said web comprises interconnected container blanks, said load having a lower surface which rests on said load surface and comprises an end face of the reel of said at least one coil and a bottom surface formed of a bottom edge of said web of interconnected container blanks.

With such a transport unit, the reel of the coil in combination with the load carrier and the load distributing element is used to form a force-absorbing structure. By the load distributing element being arranged on the upper surface of the load, the tightening force applied by the tightening strap will be absorbed by the force-absorbing structure. Thus no, or essentially no, vertical force will be absorbed by the actual web of container blanks. This results in a significantly reduced risk of upsetting or other deformation of the container blanks during handling or transport of the transport unit. With the force-absorbing structure, the load may further comprise a plurality of coils of container blanks without their damaging each other or interleaving. It will thus not be necessary to pack the coils individually. The force-absorbing structure has further appeared to be particularly important in the cases where the web of container blanks seen in the transverse direction of the web comprises a first portion with a first number of layers and a second portion with a second number of layers. However, the force-absorbing structure is also important in the cases where the web, seen in its transverse direction, comprises the same number of layers.

The invention further allows the transport unit without separate packings to comprise a load which comprises a plurality of coils, or even a plurality of loads, which each comprise one or more coils. This also means that the amount of packing material, and thus the cost of packing, can be reduced. The previous individual loading of each coil in a box can thus be avoided.

The web of container blanks can, seen in the transverse direction of the web, comprise a first portion with a first number of layers and a second portion with a second number of layers. For this type of container blanks, the importance of the tightening strap enclosing the force-absorbing structure to secure the load to the load carrier will be particularly great. A coil of container blanks of this type is, due to the difference in density, unstable, which renders it impossible to distribute the tightening force down through the container blanks. Such a distribution of force would in fact result in an uncontrollable risk of upsetting the web, and an unstable transport unit. The instability will be particularly obvious in the cases where the load comprises a plurality of stacked coils since this results in an obvious risk of tilting. These problems are avoided with the force-absorbing structure and the cooperation of the tightening strap with the same.

The load distributing element may extend diametrically across the upper surface of the load, and substantially beyond the circumferential surface thereof. As a result, the tightening force of the tightening strap can be transferred to and absorbed by the force-absorbing structure without causing damage to the web of container blanks in the at least one coil.

The load carrier is advantageously a load carrier of the EURO pallet type, in which the tightening strap encloses said force-absorbing structure in the longitudinal direction of the deckboards included in the load carrier. This extension of the tightening strap has, in experiments performed by the Swedish institute STFI-Packforsk, been found advantageous. More specifically, it has been found that the deflection of the load carrier is reduced, that is the bottom surface of the load carrier remains substantially flat also with the magnitude of tightening force in the tightening strap that is involved in securing this type of load to the load carrier, that is a tightening force in the order of 800-1200 N, and more preferred 900-1100 N. This tightening force has been found convenient for coils of the current type, which typically weigh between 15 and 75 kg. A substantially flat bottom surface of the load carrier is important for the stability of the transport unit.

In another embodiment, the load carrier is a load carrier of the EURO pallet type, in which the deckboards are replaced by a plate and in which the tightening strap is arranged to enclose said force-absorbing structure in the longitudinal direction of the runners included in the load carrier. It is by definition true of a EURO pallet that the runners extend in the same direction as its deckboards. This results in the same advantage in the form of a reduced risk of deflection of the load carrier also in the case where a plate is used instead of deckboards. A plate offers a further advantage by the possibility of providing, depending on its structure, a closed surface which prevents penetration of dirt and moisture from the ground. Moreover, a plate provides greater torsional stiffness than individual boards.

In the case where the load carrier is a load carrier of the EURO pallet type, the joist boards are advantageously reinforced. Reinforcement of the joist boards gives the load carrier additional torsional stiffness. The reinforcement can be obtained, for example, by an increase in dimensions, choice of cross-sectional geometry or by choice of materials.

The load may comprise a stack of coils, in which stack the reels of the respective coils are axially aligned with each other. This means that the force-absorbing structure is maintained also in the case where the load consists of a plurality of coils.

A separating element can advantageously be arranged between one coil and the next in the load. The separating element ensures that no interleaving occurs. The separating element further promotes more even spreading of the load if the load, in spite of securing and the force-absorbing structure, in the case of careless handling or transport should yield and the web of container blanks should be upset.

In the inventive transport unit, the load carrier can carry a plurality of loads and the load distributing element can extend across one or more loads. If, for instance, the load carrier carries an individual row of two loads, one and the same load distributing element can extend across both loads. If the load carrier carries a plurality of rows of loads, a load distributing element can be used for each row. Alternatively, one load distributing element for each load can be used, or one load distributing element can be used for all loads.

According to another aspect, the invention concerns a method of manufacturing a transport unit with a load which comprises at least one coil of a web of interconnected container blanks, said web being wound on a reel, said load having an upper surface and a lower surface which comprises an end face of the reel of said at least one coil and a bottom surface formed of a bottom edge of said web of interconnected container blanks. The method comprises the steps of arranging said load on a load carrier with a flat load surface in such a manner that the reel of said at least one coil is arranged perpendicular to the plane of the load carrier and that the lower surface of the load rests on said load surface, arranging a load distributing element on the upper surface of the load, and arranging a tightening strap in such a manner as to enclose a force-absorbing structure formed of the load carrier, the reel and the load distributing element to secure the load to the load carrier.

In the inventive method, use is made of the reel of the coil in combination with the load carrier and the load distributing element to form a force-absorbing structure. By the load distributing element being arranged on the upper surface of the load, the tightening force applied by the tightening strap will be absorbed by the force-absorbing structure. No, or substantially no, vertical force will thus be absorbed by the web of container blanks. This results in a significantly reduced risk of upsetting or other deformation of the container blanks during handling or transport of the transport unit. With the force-absorbing structure, the load may further comprise a plurality of coils of container blanks without the container blanks damaging each other or interleaving. The individual packing can thus be avoided. The force-absorbing structure has been found to be particularly important in the cases where the web of container blanks, seen in the transverse direction of the web, comprises a first portion with a first number of layers and a second portion with a second number of layers. However, the force-absorbing structure is also important in the cases where the web, seen in its transverse direction, comprises the same number of layers. Moreover, the method provides a transport unit which without separate packing may comprise a load which comprises a plurality of coils, or even a plurality of loads, which themselves comprise one or more coils. This also means that the amount of packing material, and thus the cost of packing, can be reduced. The previous individual loading of coils in a box each can thus be avoided.

The load distributing element is preferably arranged so as to extend diametrically across said load, and substantially beyond the circumferential surface thereof. As a result, the tightening force of the tightening strap is transferred to and taken up by the force-absorbing structure without causing damage to the web of container blanks. The load and the load carrier can be wrapped with a plastic film before arranging the load distributing element on the load.

The load carrier is advantageously a load carrier of the EURO pallet type, in which the tightening strap is arranged to enclose said force-absorbing structure in the longitudinal direction of the deckboards included in the load carrier. In the case where the deckboards are replaced by a plate, the tightening strap is advantageously arranged to enclose said force-absorbing structure in the longitudinal direction of the runners included in the load carrier. This reduces, as discussed above, the risk of deflection of the load carrier.

If the load comprises a plurality of coils, they are preferably stacked in such a manner that the reels of the respective coils are axially aligned with each other. As a result, the force-absorbing structure is maintained also in the case where the load consists of a plurality of coils.

The method may comprise the step of arranging a separating element between one coil and the next in the load. The separating element ensures that no interleaving occurs. The separating element further promotes more even spreading of the load If the load, in spite of securing and the force-absorbing structure, in case of careless handling or transport should yield and the web of container blanks should be upset.

According to the method, a plurality of loads can be arranged on said load carrier, after which the load distributing element is arranged to extend across one or more loads.

DESCRIPTION OF DRAWINGS

The invention will in the following the described in more detail by way of example and with reference to the accompanying drawings, which illustrate a currently preferred embodiment.

TECHNICAL DESCRIPTION

Figure 1:
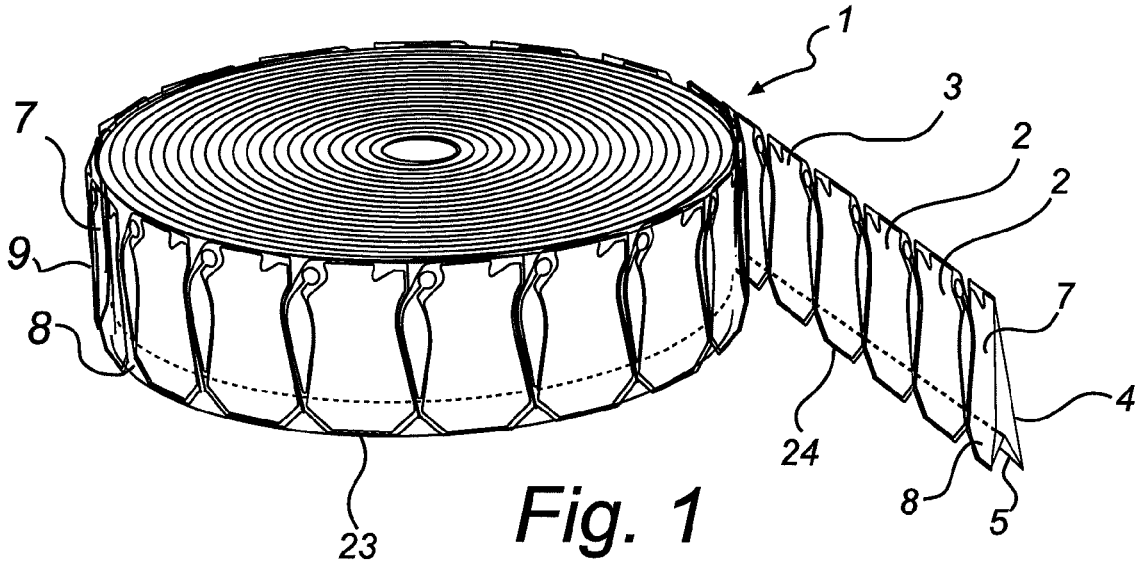
FIG. 1 is a schematic view of a coil of a web of container blanks.

With reference to FIG. 1, a coil 1 of container blanks 2 is schematically shown. The coil 1 comprises more specifically a web 3 of a large number of container blanks 2 which are arranged side by side and interconnected. The container blanks 2 are intended for manufacture of containers of a collapsible type. By this is meant a container with walls 4, 5 of a flexible plastic material which are flexible and interconnected to define a compartment whose volume is dependent on the relative position of the walls. In its unfilled state, the container, and thus its container blank 2, is flat. FIG. 1 shows the walls 4, 5 slightly separated for illustrative purposes.

In the manufacture of this type of container blanks 2, one starts suitably from a continuous web of material which is folded in the form of a W. Subsequently, the opposite wall portions 4, 5 are joined along what is referred to as connecting portions to form a closed compartment. The thus formed web 3 of container blanks 2 is then wound on a reel 6 to form a coil 1. The diameter of the coil 1 is substantially greater than the diameter of the reel 6. Moreover, the diameter of the coil 1 is greater than the height of the coil 1. As an example, a coil may contain 4500 blanks and weigh about 70 kg. A coil typically weighs between 15 and 75 kg.

The thus formed web 3 of container blanks 2 will in its transverse direction have a first portion 7 with two wall layers and a second portion 8 with four wall layers. In consequence of this difference in the number of layers, the coil 2 will have a first density in the first portion 7 and a second density in the second portion 8. This difference in density results in great difficulties during handling and transport of the coil. For instance, it will be very difficult to grip the coil. Furthermore, two coils should not be stacked on top of each other since movements and vibrations during transport and handling result in the turns of the web striving to interleave, thus causing damage to the web of material. A stack with this type of coils will also, due to the difference in density, be unstable with the ensuing risk of tilting. Tilting may result in, for example, damage to container blanks and neighbouring transport units, and also personal injuries.

Figure 2:
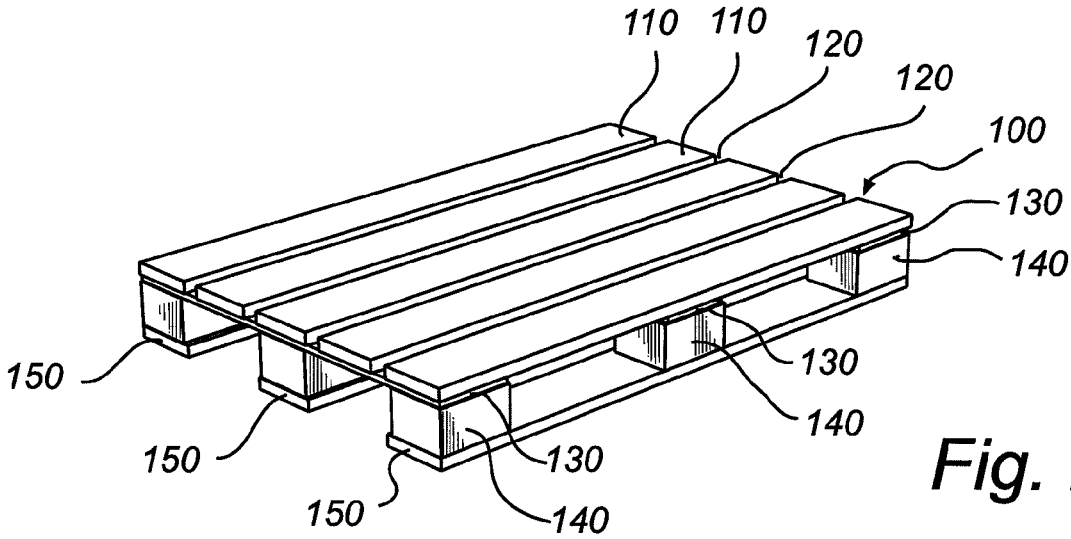
FIG. 2 is a schematic view of a standardised load carrier of the EURO pallet type.

With reference to FIG. 2, an example of a standardised load carrier 100 of the EURO pallet type is shown. The reference to FIG. 2 is made to define a number of terms that will be used in the description of the invention.

Staring from above, the load carrier 100 comprises a load surface which in the embodiment illustrated is formed of deckboards 110. The deckboards 110 extend in the longitudinal direction of the load carrier 100 and are arranged in such a manner that they form between them longitudinal gaps 120. The deckboards 110 are arranged on top of three joist boards 130. The joist boards 130 are arranged transversely to the longitudinal direction of the load carrier 100 and are positioned at the ends and in the centre of the load carrier. On the underside of each joist board 130 there are three spacer blocks 140. The spacer blocks 140 are arranged at the ends of each joist board 130 and in the centre thereof. Finally, three runners 150 are arranged on the underside of the spacer blocks 140. The runners 150 extend in the longitudinal direction of the load carrier 100, that is in the same direction as the deckboards 110, and thus connect the three spacer blocks 140 seen in the longitudinal direction of the load carrier 100.

Figure 3:
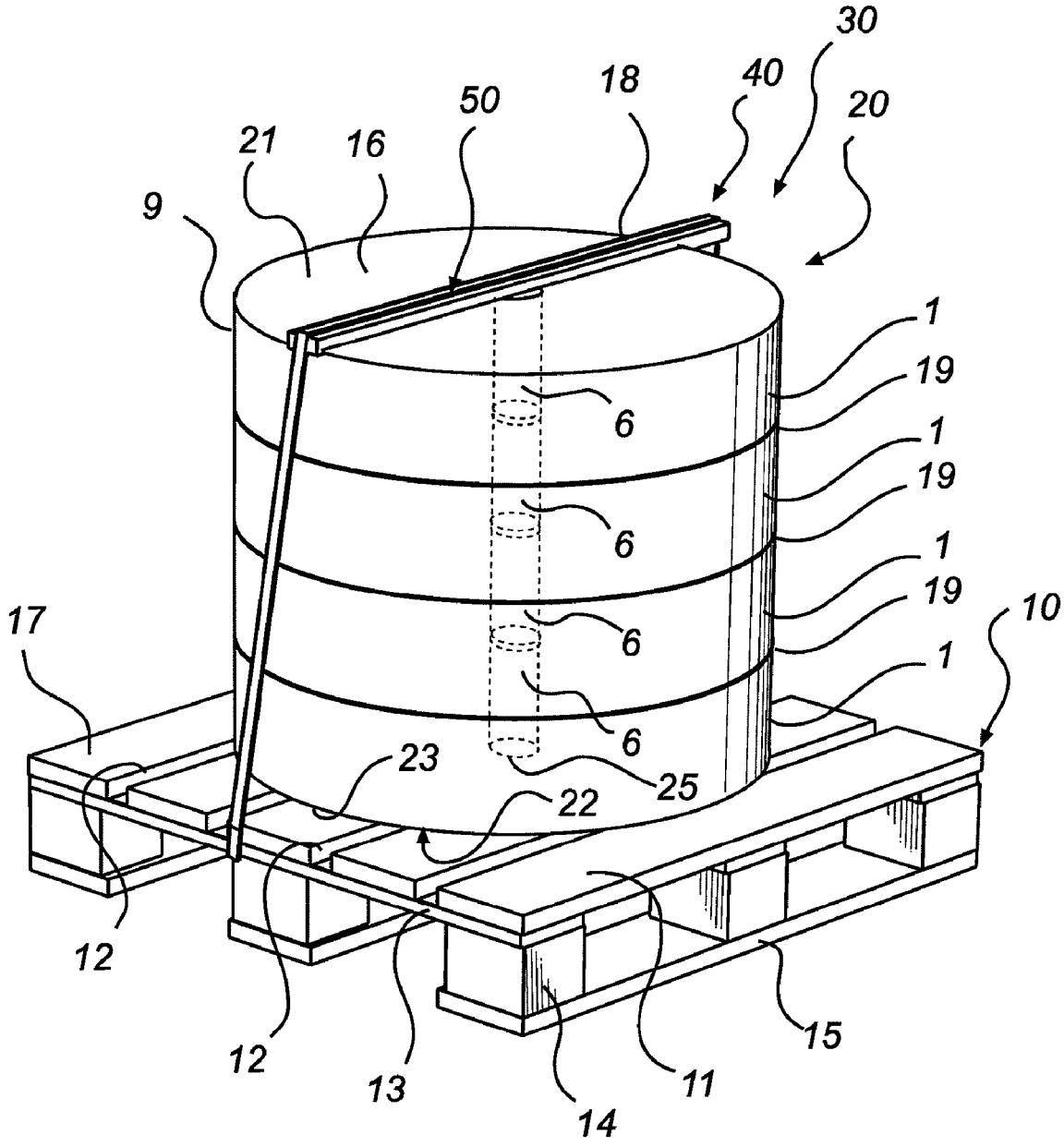
FIG. 3 illustrates an example of a transport unit with an individual load that is manufactured by the inventive method.

Reference is now made to FIG. 3, which shows a first example of a transport unit 20 according to the present invention which carries a load 30 in the form of a stack of four coils 1. The transport unit 20 comprises a load carrier 10 which has the same fundamental construction of deckboards 11, joist boards 13, spacer blocks 14 and runners 15 as the above described standardised EURO pallet 100, and will therefore not be described once more. The load carrier 10 can be both square and rectangular. The dimensions of the load carrier 10 are advantageously adjusted to the number of loads and the dimensions thereof. The width and length of the load carrier 10 suitably correspond substantially to the total diameter of the load 30, that is the total diameter of the coils 1 arranged on the load carrier 10, seen in the transverse and respectively longitudinal direction of the load carrier 10. Moreover, the intended means of transport, that is lorry or container, is to be taken into consideration for optimised use of the available load surface. The load carrier 10 need not be designed as a load pallet but can, as described above, be designed in another suitable manner.

Figure 4:
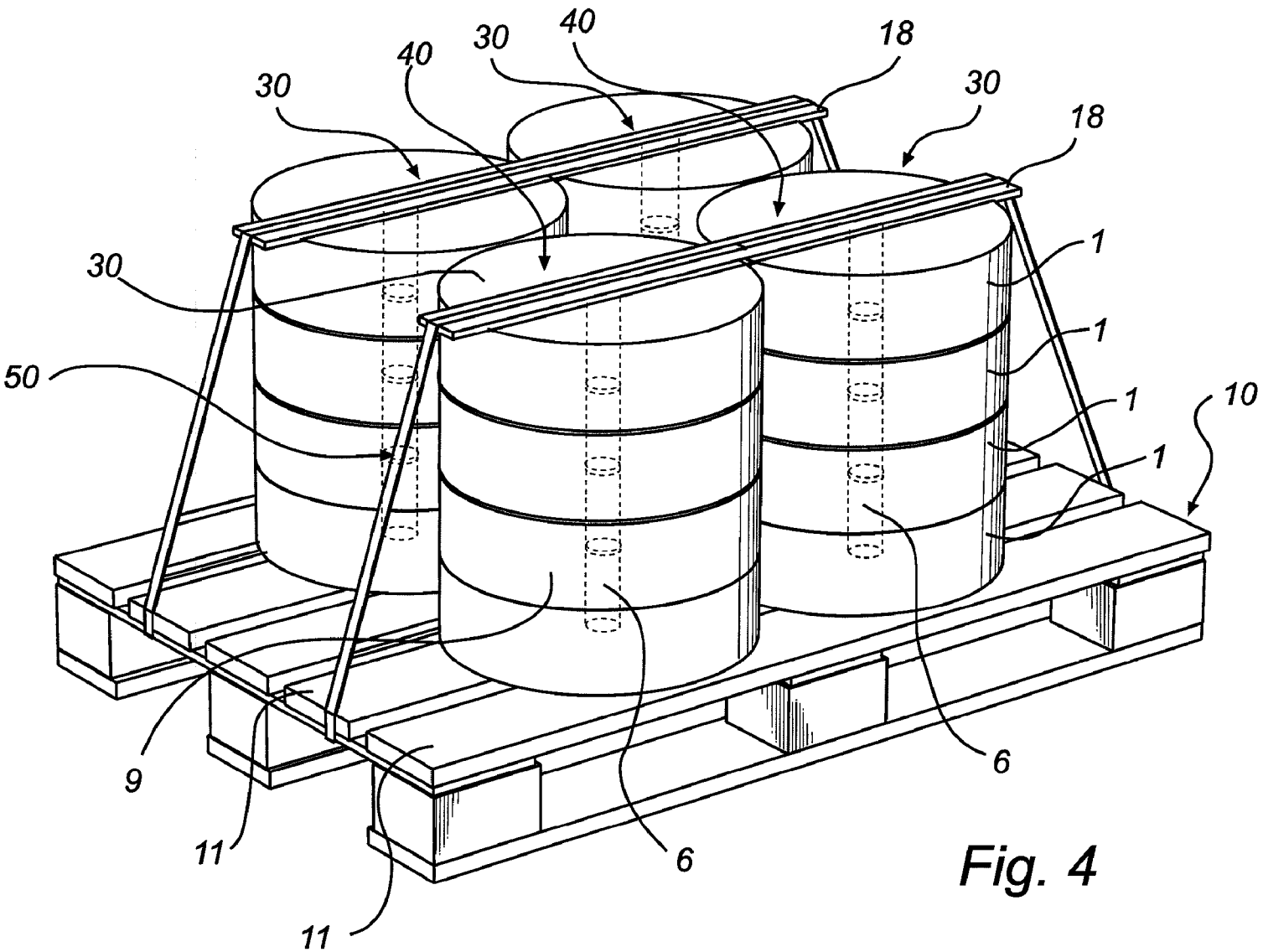
FIG. 4 illustrates schematically a second example of a transport unit which is manufactured by the inventive method. The transport unit comprises four loads.

In the example illustrated, the load carrier 10 carries a load 30 in the form of four coils 1 of container blanks 2 of the above-mentioned type. The coils 1 are arranged in a stack 16 in such a manner that the reels 6 of the respective coils 1 are axially aligned with each other and besides perpendicular to the load surface 17 of the load carrier 10. In the case where a plurality of stacks 16, see FIG. 4, are arranged on the load carrier 10, each stack 16 forms a load 30.

A load distributing element 18 extends across the load 30. The load distributing element 18 is arranged diametrically across the load 30. In one embodiment, the load distributing element 18 is of such an extent as to extend beyond the circumferential surface 9 of the load 30, that is the coils. In another embodiment, it is not necessary for the load distributing element 18 to extend beyond the circumferential surface 9 of the load 30, that is the coils. A common feature of the embodiments is that the load distributing element 18 thus rests on the upper surface of the reel 6 of the coil 1 arranged at the top of the stack 16. As a result, the load distributing element 18, the reels 6 of the coils 1 arranged in the stack 16 and also the load carrier 10 will form a force-absorbing structure 40 that will be discussed below.

The load distributing element 18 is preferably oriented so as to extend parallel to the longitudinal direction of the deckboards 11.

In the shown embodiment, the load distributing element 11 is elongated in shape and may consist of a board for instance. The elongated shape is preferred since it allows a good survey in the orientation of the load distributing element 11 relative to the reel 6. However, it will be appreciated that also other shapes are conceivable, for instance the shape of a plate.

In one embodiment, the load 30 is secured to the load carrier 10 by means of a tightening strap 50 which encloses the load carrier 10, the load 30 and the load distributing element 18 without making contact with the circumferential surface 9 of the load. More specifically, the tightening strap 50 extends in the longitudinal direction of the load distributing element 18 and in the longitudinal direction of the deckboards 11 and the runners 15. With this type of securing, the securing force applied by the tightening strap 50 will act through the force-absorbing structure 40 without affecting the circumferential surface of the load, that is without the tightening strap engaging the webs 3 of container blanks 2 wound on the reels 6.

In another embodiment, the load 30 is secured to the load carrier 10 by means of a tightening strap 50 which encloses the load carrier 10, the load 30 and the load distributing element 18, in which case the tightening strap 50 can make contact with the circumferential surface 9 of the load at one point. More specifically, the tightening strap 50 extends in the longitudinal direction of the load distributing element 18 and in the longitudinal direction of the deckboards 11 and the runners 15. With this type of securing, the securing force applied by the tightening strap 50 will act through the force-absorbing structure 40. A certain degree of contact with the circumferential surface 9 of the load can occur without the circumferential surface 9 of the load absorbing a substantial amount of force. Also in this embodiment, the risk of damage to the load will thus be reduced.

The orientation of the tightening strap 50 causes the horizontal component force of the tightening strap 50 to act parallel to the deckboards 11 and the runners 15 and, thus, in the direction in which the load carrier 10 has its maximum torsional stiffness. Furthermore, the vertical component force of the tightening strap 50 will act vertically through the force-absorbing structure 40.

The tightening strap 50 suitably consists of materials that are available on the market, such as plastic or steel. A suitable strap tension is 800-1200 N, and more preferred 900-1100 N.

In the case where the coils 1 are arranged on the load carrier 10 in stacks 16, separating elements 19 are suitably arranged between the individual coils 1 of the stack 16. The separating element 19 preferably has the form of a plate and aims substantially at avoiding interleaving between the turns of the web of two neighbouring coils. The separating element 16 can be made of, for instance, wood or cardboard. The separating element 19 also facilitates unloading of the coils 1 from the transport unit 20. The separating element 19 allows the coils 1 to be easily pushed off from the transport unit 20 without the risk of interleaving between turns of the web of two neighbouring coils.

In order to further protect the coils from environmental influence, the load carrier 10 may comprise a protective layer (not shown) in the form of, for instance, a film, paper or sheet which is arranged directly on the deckboards 11 to provide protection against dirt and moisture from the underside of the load carrier 10.

Before the transport unit 20 is provided with load distributing elements 18 and tightening straps 50, the load carrier 10 and the load 30 are preferably wrapped with a protective film (not shown) such as shrink film. Wrapping occurs on the one hand to stabilise the load and, on the other, to protect the load during transport, handling and storage.

In the above described load carrier 10 the deckboards 13 are advantageously reinforced compared with a standardised load carrier 100 of the EURO pallet type. This can take place, for example, by an increase in dimensions, selection of cross-sectional geometry or choice of materials. The purpose of the reinforcement is to increase the torsional stiffness of the load carrier. Precisely the torsional stiffness has been found important for a transport unit to meet the requirements of ASTM D 4169-04a, DC2.

The deckboards 11 can, like a load carrier 100 of the EURO type, be arranged with intermediate gaps 12. They can also advantageously be arranged next to each other without gaps 12, or alternatively be replaced by a plate. This results on the one hand in increased torsional stiffness of the load carrier and, on the other, protection against the ground to protect the load 30 from, for instance, dirt and moisture.

It will be appreciated that in the same way the runners 15 or spacer blocks 14 can be reinforced compared with the standardised dimensions that normally apply to a load carrier 100 of the EURO pallet type.

Reference is now made to FIG. 4, which shows an alternative embodiment of the inventive transport unit. The load carrier 10 has the same design as the one described above but now carries up to four loads 30 in the form of four stacks 16, each consisting of four coils 1. The load carrier 10 has the same basic construction as described above with reference to FIG. 3, and will therefore not be described again. To secure the four loads 30, use is made of two load distributing elements 18 which are arranged in the longitudinal direction of the deckboards 11. Each load distributing element 18 extends diametrically across two loads 30, that is across the reels 6. In one embodiment, the load distributing element 18 has a length so that it extends beyond the circumferential surface 9 of the two loads 30. In another embodiment, it is not necessary for the load distributing element 18 to extend beyond the circumferential surface 9 of the two loads 30. A common feature of the embodiments is that the tightening strap 50 encloses the thus formed two force-absorbing structures in the longitudinal direction of the deckboards 11. It will be appreciated that each load 30 can have a load distributing element 18 of its own.

The inventive transport unit 20 has appeared to have a number of advantages. The load distributing element 18, the reel/reels 6 and the load carrier 10 together form a force-absorbing structure 40 which together with the tightening strap 50 enables securing of the load 30 to the load carrier 10 which is very gentle on the web 3 of container blanks 2. The tightening strap 50 can enclose the force-absorbing structure 40 and secure the load 30 to the load carrier 10. The risk of upsetting the web 3 of container blanks 2, due to the tightening strap 50 affecting the circumferential surface 9 of the load, thus is significantly reduced. This means that coils 1 of container blanks 2 of the above-mentioned type, despite their instability caused by their difference in density, can be loaded and transported in this type of transport unit without being damaged due to upsetting or interleaving, whether the load consists of individual coils or a plurality of stacked coils.

By the tightening strap 50 enclosing the force-absorbing structure 40 in the longitudinal direction of the deckboards 11, the load carrier's 10 own torsional stiffness is utilised, thereby avoiding the unnecessary risk of deflection of the load carrier. This in turn increases the stability of the transport unit 20 and decreases the risk of tilting. The invention has also demonstrated the possibility of further increasing the torsional stiffness of the load carrier 10 by reinforcement of the components included in the load carrier 10.

Tests according to ASTM D 4169-04a, DC2 have been performed at the Swedish institute STFI-Packforsk. This standard comprises, inter alia, a number of different drop tests and collision tests. The tests have demonstrated that a transport unit with the above described force-absorbing structure makes it possible to meet the requirements stipulated according to this standard. As a result, transport units manufactured according to the inventive method meet the current requirements in order for the forwarding agent to be liable to pay damages for any transport-related damage to the transport unit and its load. It will be appreciated that the need for reinforcement depends on the number of loads and the weight and type of the loads. By type is meant coils of container blanks for manufacturing containers of a certain volume and shape. As an example, it can be mentioned that in the cases where the load carrier was too week, the tests according to the above standard demonstrated obvious damage due to upsetting to the first portion of the respective coils in the form of a distinct indentation, that is a kind of upsetting through the major part of the diameter of the coil. When the load carrier was reinforced, this damage ceased.

It will be appreciated that the present invention is not limited to the illustrated embodiments and method steps. Several modifications and variants are conceivable and the invention is consequently defined exclusively by the appended claims.

The invention claimed is:

1. A transport unit comprising:

a load carrier;

a load which comprises at least one coil of a web, said web being wound on a reel;

a load distributing element, and a tightening strap;

said load being carried by said load carrier in such a manner that the reel of said at least one coil is arranged perpendicular to said load carrier;

said load having an upper surface facing said load distributing element, said load distributing element being arranged on the upper surface of the load; and the tightening strap enclosing a force-absorbing structure formed of the load carrier, the reel and the load distributing element and adapted to secure the load to the load carrier;

the load carrier further comprising a load carrier of the EURO pallet type, in which the tightening strap encloses said force absorbing structure in the longitudinal direction of the deckboards included in the load carrier, and the load carrier has a flat load surface;

said web further comprising interconnected container blanks, which seen in the transverse direction of the web comprises a first portion with a first number of layers and a second portion with a second number of layers;

said load having a lower surface which rests on said load surface and comprises an end face of the reel of said at least one coil and a bottom surface formed of a bottom edge of said web of interconnected container blanks; and;

said load distributing element extending diametrically across the upper surface of said load and beyond the circumferential surface thereof.

2. A transport unit as claimed in claim 1, in which the load carrier is a load carrier of the EURO pallet type, in which the deckboards are replaced by a plate and in which the tightening strap is arranged to enclose said force absorbing structure in the longitudinal direction of the runner boards included in the load carrier.

3. A transport unit as claimed in claim 1, in which the load carrier is a load carrier of the EURO pallet type, in which the joist boards are reinforced.

4. A transport unit as claimed in claim 1, in which the load comprises a stack of coils, in which stack the reels of the respective coils are axially aligned with each other.

5. A transport unit as claimed in claim 1, comprising a separating element between one coil and the next in the load.

6. A transport unit as claimed in claim 1, in which the load carrier carries a plurality of loads, and in which the load distributing element extends across one or more loads.

7. A transport unit as claimed in claim 2, in which the load comprises a stack of coils, in which stack the reels of the respective coils are axially aligned with each other.

8. A transport unit as claimed in claim 3, in which the load comprises a stack of coils, in which stack the reels of the respective coils are axially aligned with each other.

9. A transport unit as claimed in claim 2, comprising a separating element between one coil and the next in the load.

10. A transport unit as claimed in claim 3, comprising a separating element between one coil and the next in the load.

11. A transport unit as claimed in claim 4, comprising a separating element between one coil and the next in the load.

12. A method of manufacturing a transport unit with a load which comprises at least one coil of a web of interconnected container blanks which seen in the transverse direction of the web comprises a first portion with a first number of layers and a second portion with a second number of layers, said web being wound on a reel, said load having an upper surface and a lower surface which comprises an end face of the reel of said at least one coil and a bottom surface formed of a bottom edge of said web of interconnected container blanks said method comprising;

arranging said load on a load carrier of the EURO pallet type with a flat load surface in such a manner that the reel of said at least one coil is arranged perpendicular to the plane of the load carrier and that the lower surface of the load rests on said load surface;

arranging a load distributing element on the upper surface of the load to extend diametrically across the upper surface of said load, and beyond the circumferential surface thereof; and arranging a tightening strap in the longitudinal direction of the deckboards included in the load carrier in such a manner as to enclose a force-absorbing structure formed of the load carrier, the reel and the load distributing element to secure the load to the load carrier.

13. A method as claimed in claim 12, in which the load distributing element is arranged.

14. A method as claimed in claim 12, in which the load and the load carrier are wrapped with plastic film before arranging said load distributing element.

15. A method as claimed in claim 12, in which the load carrier is a load carrier of the EURO pallet type, in which the deckboards are replaced by a plate, and in which the tightening strap is arranged to enclose said force absorbing structure in the longitudinal direction of the runners included in the load carrier.

16. A method as claimed in claim 12, in which the coils of the load are stacked in such a manner that the reels of the respective coils are axially aligned with each other.

17. A method as claimed in claim 12, comprising the step of arranging a separating element between one coil and the text in the load.

18. A method as claimed in claim 12, in which a plurality of loads are arranged on said load carrier and in which said load distributing element is arranged to extend across one or more loads.

19. A method as claimed in claim 13, in which the load carrier is a load carrier of the EURO pallet type, in which the deckboards are replaced by a plate, and in which the tightening strap is arranged to enclose said force absorbing structure in the longitudinal direction of the runners included in the load carrier.

20. A method as claimed in claim 14, in which the load carrier is a load carrier of the EURO pallet type, in which the deckboards are replaced by a plate, and in which the tightening strap is arranged to enclose said force absorbing structure in the longitudinal direction of the runners included in the load carrier.

* * * * *